US005996450A

United States Patent [19]

St. John

[11] Patent Number: 5,996,450

[45] Date of Patent: Dec. 7, 1999

[54] PLIERS (2)

[75] Inventor: Robert A. St. John, Cheshire, Conn.

[73] Assignee: The Stanley Works, New Britain, Conn.

[21] Appl. No.: 09/116,562

[22] Filed: Jul. 15, 1998

[51] Int. Cl.[6] ..... B25B 7/04

[52] U.S. Cl. ..... 81/416

[58] Field of Search ..... 81/387, 393, 394, 81/385, 405, 407, 408, 411, 418, 416

[56] References Cited

U.S. PATENT DOCUMENTS

| | | |
|---|---|---|
| 31,849 | 3/1861 | Knapp . |
| D. 56,979 | 1/1921 | Larson . |
| D. 119,441 | 3/1940 | Sandy . |
| D. 135,759 | 6/1943 | Wiljamaa . |
| D. 136,188 | 8/1943 | Payne . |
| 198,678 | 12/1877 | Poole . |
| D. 255,539 | 6/1980 | Graham . |
| D. 327,208 | 6/1992 | Wehling . |
| D. 355,806 | 2/1995 | Visic . |
| 460,438 | 9/1891 | Haunty . |
| 460,704 | 10/1891 | Hansen . |
| 464,860 | 12/1891 | Duvall . |
| 467,025 | 1/1892 | Wreden . |
| 522,904 | 7/1894 | Krank . |
| 556,644 | 3/1896 | Rivard . |
| 562,260 | 6/1896 | Toquet . |
| 611,537 | 9/1898 | Ward . |
| 1,048,753 | 12/1912 | Von Den Steinen . |
| 1,227,372 | 5/1917 | Bledsoe . |
| 1,321,777 | 11/1919 | Stepanian . |
| 1,459,551 | 6/1923 | Hanson . |
| 1,472,312 | 10/1923 | Singer . |
| 1,472,517 | 10/1923 | Fry . |
| 1,485,318 | 2/1924 | Way . |
| 1,522,695 | 1/1925 | Noreen . |
| 1,558,399 | 10/1925 | Rylen . |
| 1,639,183 | 8/1927 | Ingram . |
| 1,772,224 | 8/1930 | Peterson ..... 81/411 X |
| 2,274,945 | 3/1942 | Van Keuren . |
| 2,766,647 | 10/1956 | Patrick . |
| 2,818,758 | 1/1958 | Swanstrom et al. . |
| 2,819,633 | 1/1958 | Boehnke . |
| 3,946,453 | 3/1976 | Torres . |
| 4,023,450 | 5/1977 | Ygfors . |
| 4,651,598 | 3/1987 | Warheit . |
| 4,662,252 | 5/1987 | Warheit . |
| 4,738,169 | 4/1988 | Wyka . |
| 4,802,390 | 2/1989 | Warheit . |
| 4,907,477 | 3/1990 | Farber . |
| 4,995,128 | 2/1991 | Montgomery et al. . |
| 5,020,399 | 6/1991 | Annis et al. . |
| 5,033,338 | 7/1991 | Ford, Jr. . |
| 5,060,543 | 10/1991 | Warheit . |
| 5,062,328 | 11/1991 | Demurger . |
| 5,172,614 | 12/1992 | Monnet et al. . |
| 5,176,048 | 1/1993 | Jure et al. . |
| 5,245,721 | 9/1993 | Lowe et al. . |
| 5,249,490 | 10/1993 | Kennel . |
| 5,259,277 | 11/1993 | Zurbuchen . |
| 5,327,602 | 7/1994 | Stenger . |
| 5,351,584 | 10/1994 | Warheit ..... 81/416 X |
| 5,394,773 | 3/1995 | Zurbuchen et al. . |
| 5,432,968 | 7/1995 | Beck . |
| 5,448,932 | 9/1995 | Zurbuchen et al. . |
| 5,660,089 | 8/1997 | Chow . |

FOREIGN PATENT DOCUMENTS

| | | |
|---|---|---|
| 616214 | 3/1961 | Canada ..... 81/385 |
| 887557 | 11/1943 | France . |

*Primary Examiner*—David A. Scherbel
*Assistant Examiner*—Anthony Ojini
*Attorney, Agent, or Firm*—Pillsbury Madison & Sutro LLP

[57] ABSTRACT

A pliers comprises a pair of elongated members having jaw portions, handle portions, and neck portions therebetween with the neck portions overlying each other and the jaw portions thereof having opposed clamping faces. The elongated members have oppositely arching slots in their neck portions and pivot pins which slide in the slot of the other member. The elongated members of the pliers may be fabricated as laminates of sheet metal with one neck portion extending through a passage in the other neck portion. Solid jaw inserts may be secured to the jaw portions of the sheet metal elements to provide the clamping surfaces.

15 Claims, 5 Drawing Sheets

PLIERS (2)

BACKGROUND OF THE INVENTION

The present invention relates to pliers in which the elongated elements of the pliers are pivotable about a pair of pivot points to provide improved clamping action.

Pliers are conventionally comprised of a pair of elongated members with jaws at one end and handle portions at the other end. In some instances, the pivot for the two jaws is fixed and in other instances, a pivot pin is slidable in a slot to allow some translation of the members relative to each other in an effort to improve the gripping orientation of the jaw portions of the pliers in what is known as a slip-joint structure. Exemplary of a slip-joint pliers is Patrick U.S. Pat. No. 2,766,647. More recently, there have been substantial efforts to provide self-adjusting pliers such as illustrated in Warheit U.S. Pat. Nos. 4,662,252 and 5,060,543.

In Jore et al U.S. Pat. No. 5,176,048 there is proposed a pliers construction in which there is not only a first pivot point but also a cam surface in which a second pivot pin is moved to effect parallel movement of the jaw faces.

It is conventional to employ offsetting of the neck portions to allow the neck portions to pivot and slide relative to one another while maintaining the jaws in opposing relationship for gripping of workpieces therebetween. To avoid the necessity for producing such offset jaw portions, some patents propose the construction of pliers with laminated jaw portions to provide opposing clamping faces, such as, for example, Warheit U.S. Pat. Nos. 4,662,252 and 5,351,584.

It is an object of the present invention to provide a novel pliers employing a pair of spaced pivots about which the jaw portions pivot to enable rapid adjustment and application of clamping force to a gripped workpiece.

It is also an object to provide such a pliers which can be quickly and readily fabricated.

Another object is to provide such pliers in which the elongated elements are laminates of multiple sheet metal pieces.

SUMMARY OF THE INVENTION

It has now been found that the foregoing and related objects may be readily attained in pliers comprising first and second elongated members with a jaw portion at one end, a handle portion at the other end and a neck portion therebetween. The neck portions of the elongated members overlie each other and the outer ends of the jaw portions thereof have opposed clamping faces in abutting relationship in the closed position. Each of the elongated members has an arcuate slot in the neck portion thereof, and one of the slots arches and is disposed adjacent the jaw portions. The other of the slots arches and is disposed adjacent the handle portions. The elongated member with the first mentioned slot therein has a pivot aperture aligned with the second mentioned slot; the other elongated member has a pivot aperture aligned with the first mentioned arcuate slot.

Pivot pins are seated in the pivot apertures and are slidable in the arcuate slots, and the neck portions of the members are slidable relative to each other with the pivot pins sliding in the slots when the handle portions are pivoted relative to each other to open and close the jaw portions.

In one embodiment, each of the elongated members is a laminate of a plurality of elements. One of the elongated members has outer elements which are spaced apart to provide a passage in the neck portion thereof in which is slidably seated the neck portion of the other of the elongated members. The one elongated member includes at least one additional laminate element between the outer elements in the jaw portion thereof to fill the spacing therebetween. The other elongated member has additional laminate elements in the jaw portion thereof to equal substantially the width of the clamping face of the jaw portion of the one elongated member.

Preferably, the arcuate slots are disposed substantially to one side of an imaginary line extending between the outer ends of the clamping faces of the jaw portions. The inner ends of the slots are spaced apart at the ends thereof adjacent the imaginary line and overlie each other at the outer or other ends thereof. Desirably, the pivot apertures and pins, and the inner ends of the slots are disposed substantially along this imaginary line.

The jaw portions of the elongated member may include solid metal jaw inserts to provide the clamping faces, and these are conveniently seated in recesses provided by the sheet metal elements.

DETAILED DESCRIPTION OF THE ILLUSTRATED EMBODIMENT

Figure 1:
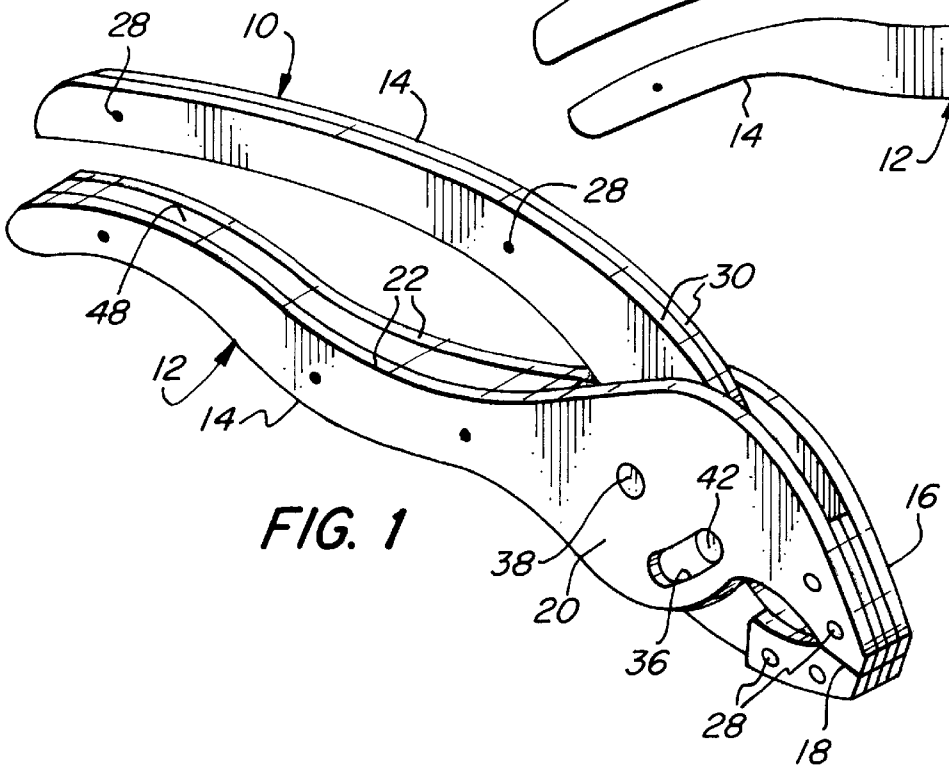
FIG. 1 is a perspective view of pliers embodying the present invention with the jaw portions in a closed position.
Figure 6:
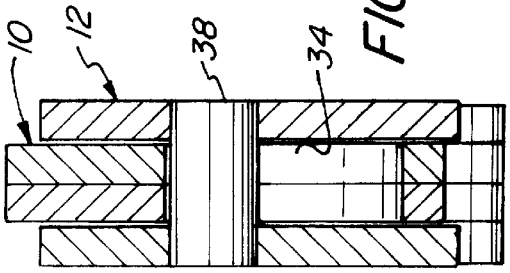
FIG. 6 is a sectional view along the line 6—6 of FIG. 2 drawn to an enlarged scale.
Figure 7:
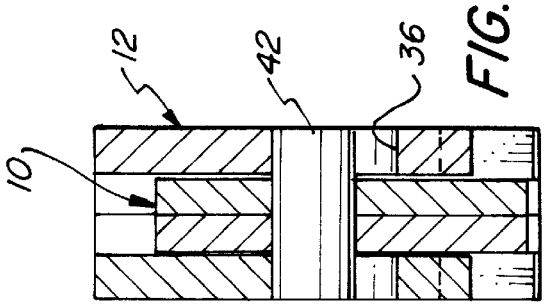
FIG. 7 is a sectional view along the line 7—7 of FIG. 2 drawn to an enlarged scale.

Turning first to FIG. 1, a pliers embodying the present invention is comprised of a pair of elongated laminated members generally designated by the numerals 10,12. Each has an elongated handle portion 14 at one end, a jaw portion 16 at the other end and a neck portion 20 therebetween. The jaw portions 16 have clamping faces 18 which, when closed, generally extend in a common plane adjacent their outer end with diverging arcuate portions spaced from the outer ends The elongated member 10 is a laminate of two elongated sheet metal elements 30 which are in face-to-face contact and assembled by rivets 28 or the like.

Figure 5:
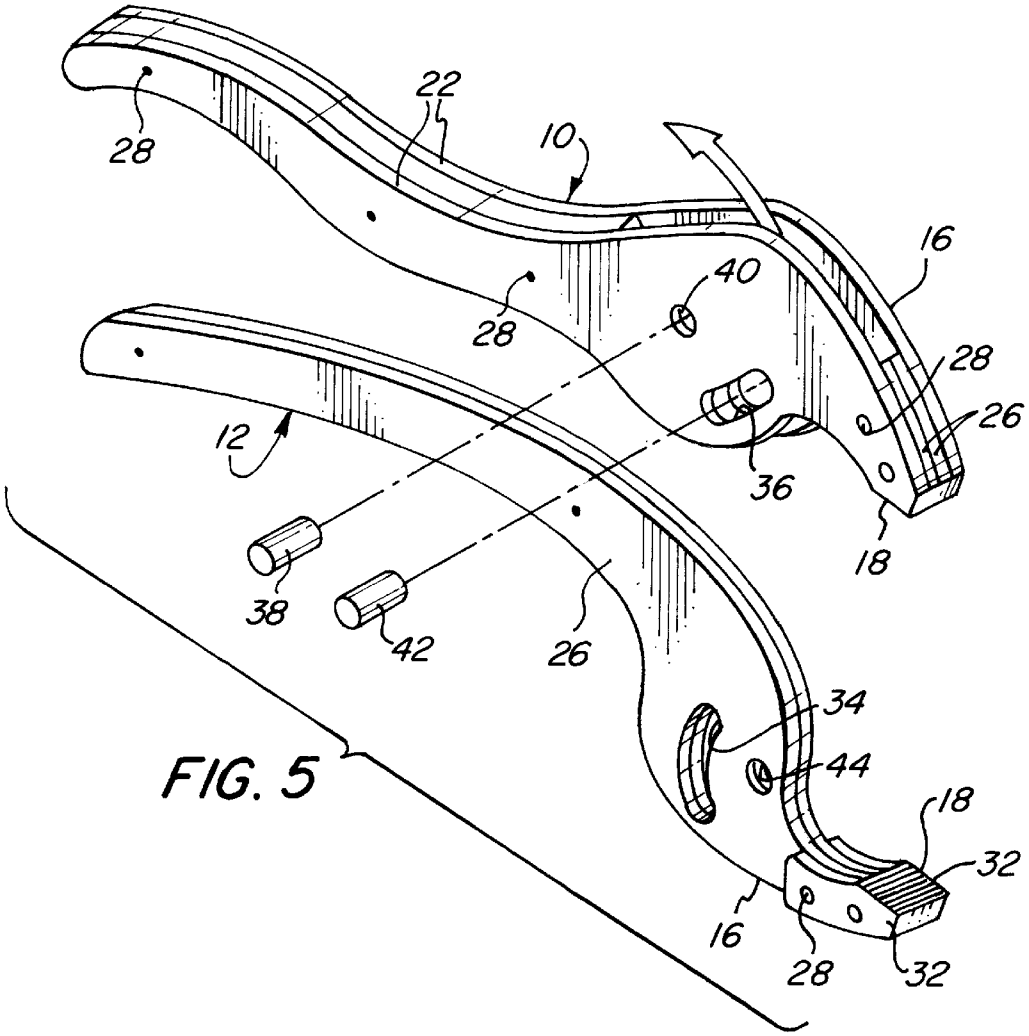
FIG. 5 is a partially exploded view thereof.

The elongated member 12 has a pair of elongated sheet metal laminate elements 22 which are spaced apart at their neck portion 20 so as to provide a passage 24 therebetween in which is disposed the neck portion 20 of the elongated member 10. As best seen in FIG. 5, a pair of filler laminate jaw elements 26 are provided in the jaw portion 16 of the elongated member 10 so as to provide a solid clamping face 18. Similarly, a pair of added jaw laminate elements 32 are assembled onto the elongated laminate elements 26 at the jaw portion 16 of the elongated member 12 to provide a clamping face 18 which is coextensive and works with the clamping face 18 of the elongated member 10.

The elongated member 10 has an arcuate slot 36 formed in its neck portion 20 adjacent the jaw portion 16, and the elongated member 12 has an aperture 44 formed therein in which is fixed a pivot pin 42 which extends therethrough and has its end portions slidably seated in the arcuate slot 36 of the elongated member 10.

The elongated member 12 has an oppositely oriented arcuate slot 34 in its neck portion 20 arching away from the jaw portion 16. The elongated member 10 has apertures 40 in its laminate elements 22 in which is fixedly seated the ends of the pivot pin 38, and its shank extends through the slot 34 and is slidable therein.

In the illustrated embodiment, a filler element 48 is provided between the laminate elements 22 in the handle portion 14 of the member to, and may be secured therebetween by rivets 28, adhesive or other suitable means. However, the handle portion of the elements 22 may be bent towards each other adjacent their neck portion so as to be in abutting surface relationship, and this is preferable to eliminate the need for any filler therebetween.

Figure 3:
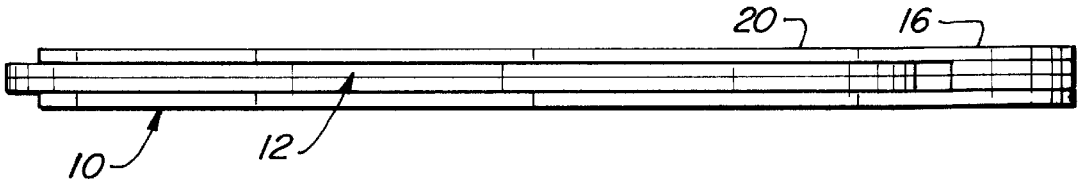
FIG. 3 is a side elevational view thereof.
Figure 2:
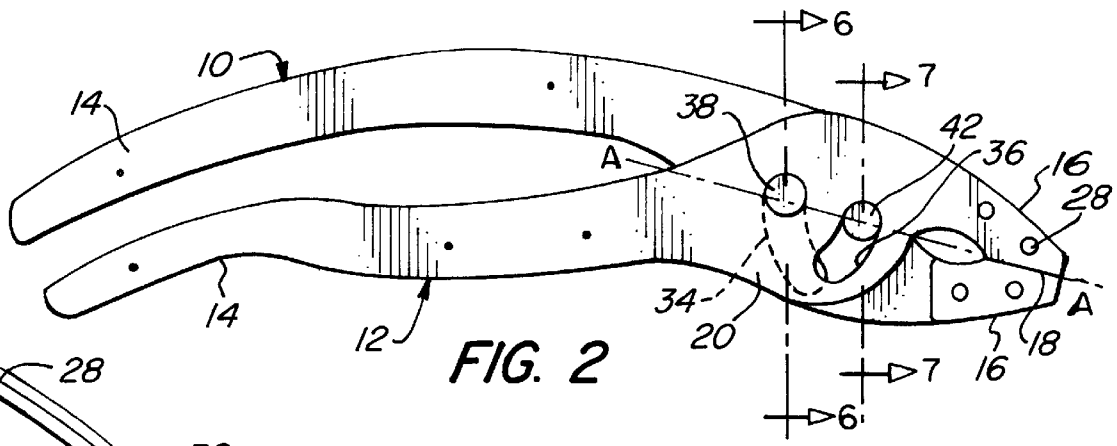
FIG. 2 is a plan view thereof with a slot in the inner member shown in phantom line.
Figure 4:
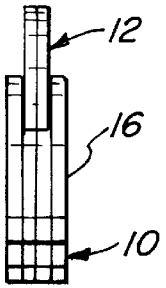
FIG. 4 is an elevational view of the jaw end thereof.

As best seen in FIG. 2, the arcuate slot 36 arches towards the jaw portion 16 and is spaced most closely to the jaw portion 16 while the arcuate slot 34 arches away from the jaw portion 16 and is spaced towards the handle portion 14. The pivot apertures 40,44 are located along an imaginary line A—A which is an extension of the plane of the generally rectilinear outer portion of the abutting clamping faces 18 of the jaw portions 16, and the inner ends of the slots 34,36 are spaced furthest apart along the imaginary line A—A while their outer ends overlap in the closed position of the members 10,12.

Turning now to FIGS. 8–11, therein illustrated diagrammatically is the operation of the double pivot arrangement of the present invention.

Figure 8:
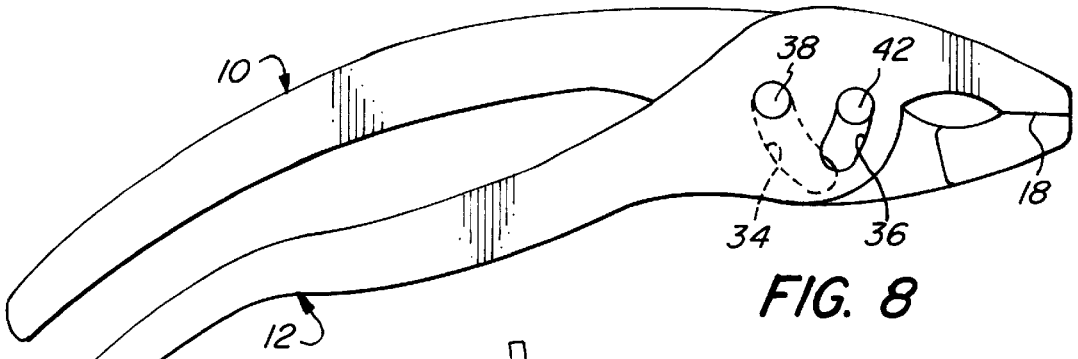
FIG. 8 is a partially diagrammatic view showing the plier members with the jaws in a closed position.

As seen in FIG. 8, when the pliers are in their fully closed position, both pivot pins 38,42 are seated at the inner ends of the slots 34,36, essentially along the imaginary line defined by the rectilinear outer end of the clamping faces 18 of the jaw portions 16.

Figure 9:
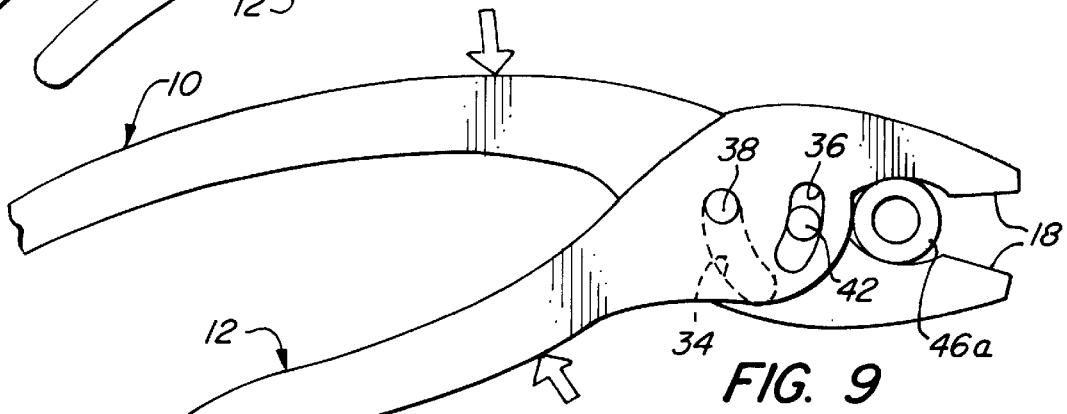
FIG. 9 is a similar view with the plier members pivoted to provide a partially open position of the jaws to grip a relatively small workpiece.

As seen in FIG. 9, when the clamping elements 10,12 are pivoted to open the jaw portions 16 to receive the relatively small diameter workpiece 46*a* in the arcuate portions of the clamping faces 18, the pivot pin 38 remains at the inner end of the slot 34 and the member 12 pivots thereabout while the pin 42 moves outwardly in the slot 36.

Figure 10:
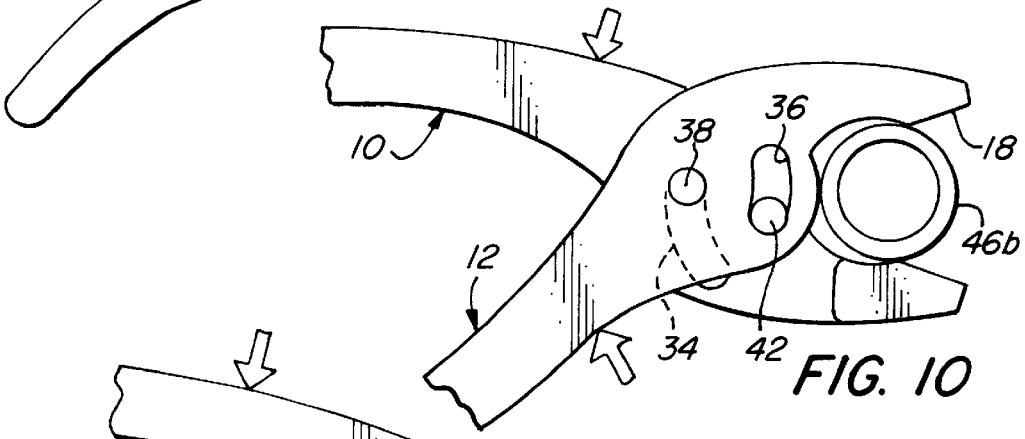
FIG. 10 is a similar fragmentary view showing the jaws in a further opened position to grip a large workpiece.

As seen in FIG. 10, opening of the jaws 16 still further to seat the larger diameter workpiece 46*b* causes the pivot pin 42 to move to the outer end of the slot 36 while the pivot pin 38 remains at the inner end of the slot 34 to provide the pivot point.

Figure 11:
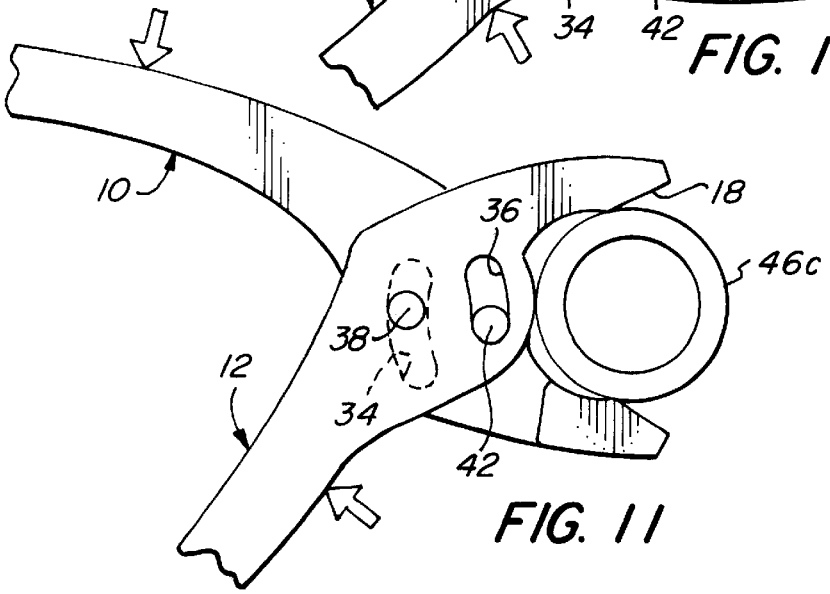
FIG. 11 is a view similar to FIG. 10 with the jaws in a full open position to grip a still larger workpiece.

As seen in FIG. 11, opening the jaws 16 still further to seat the larger diameter workpiece 46*c* now causes the elongated member 10 to pivot about the pivot pin 42 and the pivot pin 38 moves outwardly in the slot 34.

Thus, it can be seen that there is a firm pivot position at all positions of the jaw portions and a good clamping force can be applied to the gripped workpiece.

Figure 12:
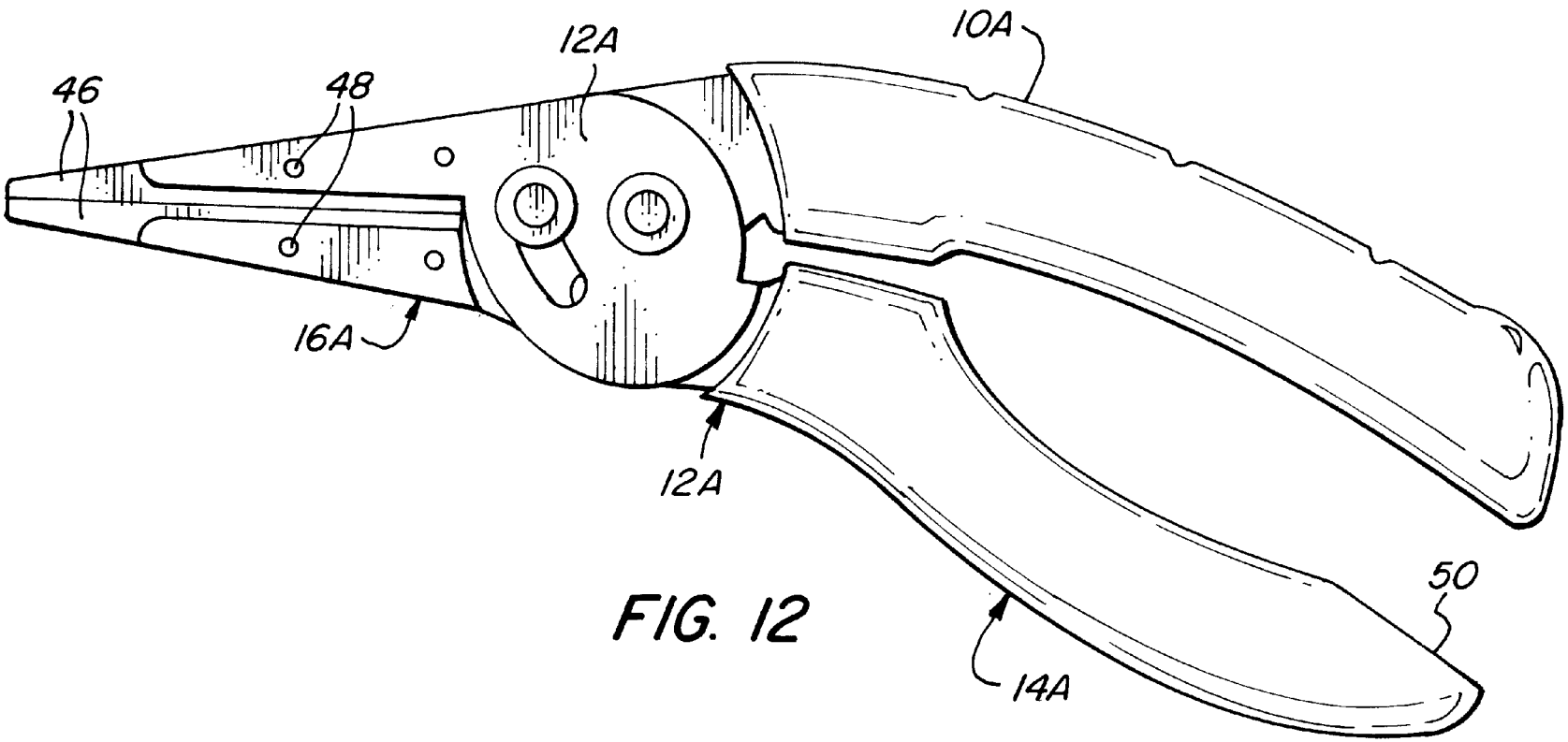
FIG. 12 is a plan view of a needle nose pliers embodiment of the present invention utilizing jaw inserts.

Turning next to FIG. 12, therein illustrated is a needle nose pliers embodying the present invention in which the elongated members 10A, 12A have elongated elements 22A, jaw portions 16A providing recesses in which are seated solid jaw elements 46 which are secured thereto by rivets 48 or the like. In this embodiment, the handle portions 14A have molded synthetic resin covering 50.

Figure 13:
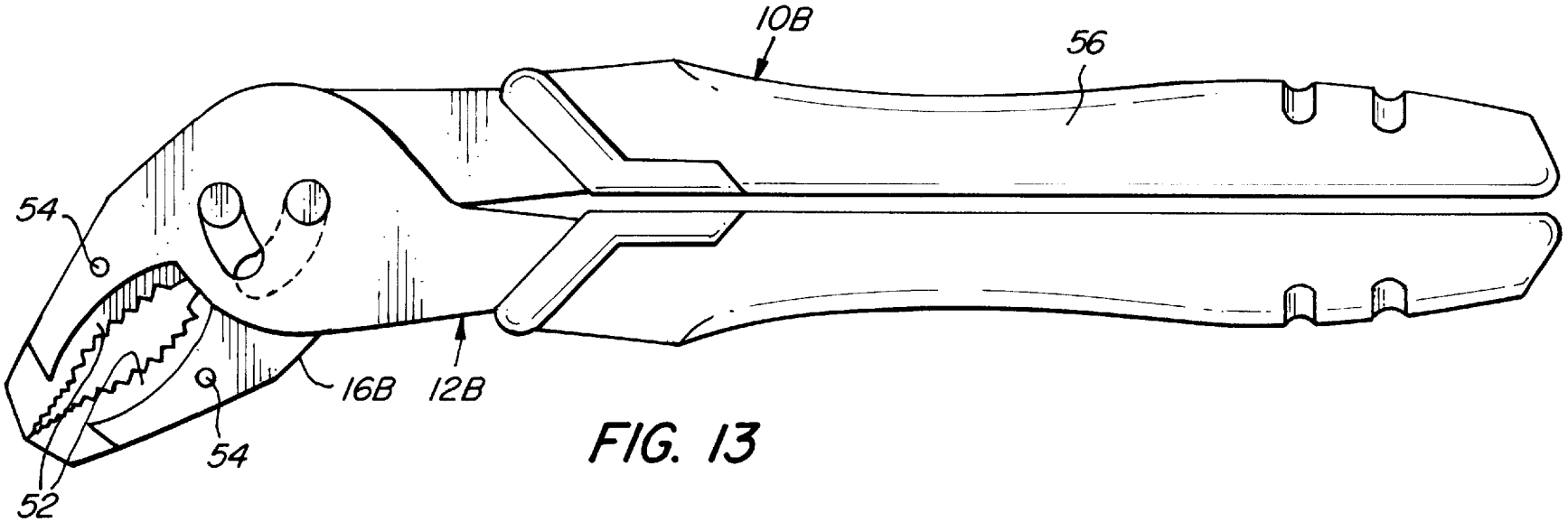
FIG. 13 is a plan view of a groove joint pliers embodiment of the present invention also using jaw inserts.

FIG. 13 illustrates a groove joint pliers embodying the invention which similarly has recesses formed by the jaw portions 16B of the elongated elements 22B in which are seated solid jaw elements 52 secured thereto by rivets 54. It also has a molded resin covering 56 on its handle portion 14B.

As will be readily appreciated, other configurations for the one elongated members to provide a passage at the neck portion for the other elongated member may also be employed. As indicated above, the handle portions may be offset inwardly so as to allow the bulk of the handle portions to be in surface-to-surface contact, thus eliminating the need for a filler piece. Moreover, additional elongated elements of sheet metal may be employed for each of the elongated members as well as for the jaw portions.

In practice, it has been found advantageous to mold a synthetic resin grip about both handle portions to provide a comfortable gripping surface. This process of molding can also provide the filler between the spaced laminate elements. Moreover, a portion of one or both of the laminate element can be offset to provide an abutment spacing element, conveniently at the end of the handle portion so as to maintain the rigidity of the assembly. In molding of the grip, a first resin of relatively rigid nature may be molded about the sheet metal members and then a more resilient resin molded thereover.

The shape of the clamping surfaces of the jaws can also vary considerably depending upon the application for the pliers. Slip joint, needle nose and water pump embodiments have been illustrated. Other conventional types include linesman and wire cutting.

The clamping faces are conveniently provided with teeth or serrations to facilitate gripping of the workpiece. Alternatively, they can be provided with a friction enhancing hard metallic surface deposit.

As will be readily appreciated, the laminate elements can be formed conveniently from the sheet metal in a stamping operation and assembled quickly and conveniently by simple riveting operations with the pins force-fit into the pivot apertures of the elements to secure them in place.

As seen in FIGS. 12 and 13, the clamping surfaces of the jaw portions may be provided by solid metal inserts which can be sintered cast or forged to provide a durable gripping surface. They may be secured to the sheet metal laminate elements by rivets, welding or brazing.

Thus, it can be readily seen from the foregoing detailed description and attached drawings that the pliers of the present invention provides a novel two pivot structure enabling facile adjustment of the spacing between the clamping faces and effective transfer of the force applied to the handles to the clamping surfaces of the jaws to grip firmly a workpiece between. The pliers can be readily fabricated from inexpensive sheet metal to provide the structural elements which may then be assembled quickly and economically by simple riveting operations.

Having thus described the invention, what is claimed is:

1. A pliers comprising:

(a) a first elongated member having a jaw portion at one end, a handle portion at the other end and a neck portion therebetween;

(b) a second elongated member having a jaw portion at one end, a handle portion at the other end and a neck portion therebetween, said neck portions of said elongated members overlying each other and said jaw portions thereof having opposed clamping faces in abutting relationship, each of said elongated members having an arcuate slot in said neck portion thereof, one of said slots arching and being disposed towards said jaw portions and the other of said slots arching and being disposed towards said handle portions, said elongated member with said one slot therein having a pivot aperture therein aligned with said other arcuate slot and said member with said other slot having a pivot aperture therein aligned with said one arcuate slot; and (c) pivot pins seated in said pivot apertures and slidable in said arcuate slots, said neck portions of said members being slidable relative to each other with said pivot pins sliding in said slots when said handle portions are pivoted relative to each other to open and close the jaw portions.

2. The pliers in accordance with claim 1 wherein each of said elongated members is a laminate of a plurality of elements.

3. The pliers in accordance with claim 2 wherein one of said elongated members has outer elements which are spaced apart to provide a passage in said neck portion thereof in which is slidably seated said neck portion of the other of said elongated members.

4. The pliers in accordance with claim 3 wherein said one elongated member includes at least one additional laminate element between said outer elements in said jaw portion thereof to fill the spacing therebetween.

5. The pliers in accordance with claim 4 wherein said other elongated member has additional laminate elements in said jaw portion thereof to equal substantially the width of the clamping face of said jaw portion of said one elongated member.

6. The pliers in accordance with claim 1 wherein said arcuate slots are disposed substantially to one side of an imaginary line extending between the clamping faces of said jaw portions.

7. The pliers in accordance with claim 6 wherein said slots are spaced apart at the ends thereof adjacent said imaginary line and overlie each other at the other ends thereof.

8. The pliers in accordance with claim 6 wherein said pivot apertures and pins are disposed substantially along said imaginary line.

9. The pliers in accordance with claim 1 wherein said jaw portions of said elongated members include solid metal jaw inserts providing said clamping faces.

10. The pliers in accordance with claim 9 wherein each of said elongated members comprises a laminate of a plurality of sheet metal elements, said elements providing a recess at the jaw portions thereof in which said jaw insert is seated.

11. A pliers comprising:

(a) a first elongated member having a jaw portion at one end, a handle portion at the other end and a neck portion therebetween;

(b) a second elongated member having a jaw portion at one end, a handle portion at the other end and a neck portion therebetween, said neck portions of said elongated members overlying each other and said jaw portions thereof having opposed clamping faces in abutting relationship, each of said elongated members having an arcuate slot in said neck portion thereof, one of said slots arching and being disposed towards said jaw portions and the other of said slots arching and being disposed towards said handle portions, said arcuate slots being disposed substantially to one side of an imaginary line extending between the clamping faces of said jaw portions, said elongated member with said one slot therein having a pivot aperture therein aligned with said other arcuate slot and said member with said other slot having a pivot aperture therein aligned with said one arcuate slot, each of said elongated members being a laminate of a plurality of elements, and one of said elongated members having outer elements which are spaced apart to provide a passage in said neck portion thereof in which is slidably seated said neck portion of the other of said elongated members; and (c) pivot pins seated in said pivot apertures and slidable in said arcuate slots, said neck portions of said members being slidable relative to each other with said pivot pins sliding in said slots when said handle portions are pivoted relative to each other to open and close the jaw portions.

12. The pliers in accordance with claim 11 wherein said one elongated member includes at least one additional laminate element between said outer elements in said jaw portion thereof to fill the spacing therebetween, and said other elongated member has additional laminate elements in said jaw portion thereof to equal substantially the width of the clamping face of said jaw portion of said one elongated member.

13. The pliers in accordance with claim 11 wherein said slots are spaced apart at the ends thereof adjacent said imaginary line and overlie each other at the other ends thereof, said pivot apertures and pins are disposed substantially along said imaginary line.

14. The pliers in accordance with claim 11 wherein said jaw portions of said elongated members include solid metal jaw inserts providing said clamping faces.

15. The pliers in accordance with claim 14 wherein each of said elongated members comprises a laminate of a plurality of sheet metal elements, said elements providing a recess at the jaw portions thereof in which said jaw insert is seated.

* * * * *